US010279971B2

(12) United States Patent
McCarren et al.

(10) Patent No.: US 10,279,971 B2
(45) Date of Patent: May 7, 2019

(54) CABLE RETAINERS FOR PACKAGING

(71) Applicant: Apple Inc., Cupertino, CA (US)

(72) Inventors: Jonathan M. McCarren, San Francisco, CA (US); Mark T. Uyeda, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/701,040

(22) Filed: Sep. 11, 2017

(65) Prior Publication Data

US 2018/0273262 A1 Sep. 27, 2018

Related U.S. Application Data

(63) Continuation-in-part of application No. 15/467,917, filed on Mar. 23, 2017, now Pat. No. 10,179,691.

(51) Int. Cl.

| | |
|---|---|
| ***B65D 61/00*** | (2006.01) |
| ***B65D 85/04*** | (2006.01) |
| ***B65D 73/00*** | (2006.01) |
| *B65H 55/00* | (2006.01) |
| *B65H 75/36* | (2006.01) |

(52) U.S. Cl.

CPC ..... *B65D 61/00* (2013.01); *B65D 73/0042* (2013.01); *B65D 73/0085* (2013.01); *B65D 85/04* (2013.01); *B65H 55/00* (2013.01); *B65H 75/364* (2013.01); *B65H 2701/3919* (2013.01)

(58) Field of Classification Search

CPC ..... B65B 5/04; B65B 63/04; B65D 61/00; B65D 73/00; B65D 73/0042; B65D 73/0085; B65D 85/04; B65H 3/00; B65H 55/00; B65H 75/06; B65H 75/26; B65H 75/364; B65H 2701/3919

USPC ..... 206/303, 388, 394–398

See application file for complete search history.

(56) References Cited

U.S. PATENT DOCUMENTS 4,179,030 A * 12/1979 Hayes ..... B65D 85/672 206/396

9,975,692 B2 * 5/2018 Pincus ..... B65D 85/671

* cited by examiner

*Primary Examiner* — Bryon P Gehman

(74) *Attorney, Agent, or Firm* — Sterne, Kessler, Goldstein & Fox P.L.L.C.

(57) ABSTRACT

Cable retainers for cables are disclosed. The cable retainers may include a panel having a pair of loop locks. The loop locks may engage each other to form a loop. The cable retainer may include a first and a second retention loop. Each retention loop may have a finger with a slot formed at a fold line of the finger. Each retention loop may also have a flap with a tab formed at a fold line of the flap. The finger and the flap of the first retention loop may be located directly across the panel from one another. The finger of the second retention loop may be located at a first end of the panel while the flap of the second retention loop may be located at a second end of the panel. The tabs and slots of each retention loop may interlock to form a rectangular cable passage. The cable may also include a reinforcement structure disposed in a retention loop. The reinforcement structure may be stepped reinforcement structure. The cable retainer may be formed entirely of paper and may be formed without and adhesive.

20 Claims, 11 Drawing Sheets

CABLE RETAINERS FOR PACKAGING

CROSS-REFERENCE TO RELATED APPLICATIONS

This application is a continuation-in-part of U.S. patent application Ser. No. 15/467,917, filed Mar. 23, 2017, titled "Cable Retainers for Packaging," which is incorporated herein by reference in its entirety.

FIELD

The described embodiments relate generally to cable retainers. More particularly, the described embodiments relate to cable retainers formed entirely of paper.

SUMMARY

In some embodiments described herein, a cable retainer includes a panel with of pair of loop locks configured to engage each other to form a loop. A first and a second retention loop may attach to the panel. Each retention loop includes a finger having a slot formed at a fold line of the finger and a flap having a tab formed at the fold line of the flap. The finger and flap of the first retention loop may be located directly across the panel from one another while the finger and flap of the second retention loop may be located at a first end and a second end of the panel, respectively. The tab of the flap mates with the slot of the finger to form a cable passage. The cable passage may be rectangular. The tab may be removed from and reinserted into the slot. The cable retainer may be formed entirely of paper, with no adhesive.

The cable retainer may be a single integrally formed piece and may be formed from a flat blank. The cable retainer may also be coated (e.g., with a laminate). Folds in the cable retainer may be preformed in the single integrally formed piece. The cable retainer may be formed entirely of a recyclable material (e.g., a paper-based material such as cardboard, paperboard, or cardstock) and may have the same number of fingers extending from the top side as the bottom side of the panel. The cable retainer may have all the fingers extending from one side of the panel.

The cable retainer may include a port securement member configured to mate with a retained cable. The port securement member may be foldable. The port securement member in the folded configuration may engage the port of a wound cable secured by the cable retainer.

A packaged cable disclosed herein may include a cable retainer and a wound cable extending through the retention loop of the cable retainer. The cable may be wound such that each loop of the cable is in contact with immediately adjacent loops along a majority of each loop.

In some embodiments fingers and tabs for a cable retainer may include finger segments and flap segments, respectively. A finger and flap may together form a retention loop, and may be coupled together by a tab formed at a fold line between the two flap segments and a slot formed at a fold line between two of the finger segments. A rectangular cable passage may be formed when the tab engages the slot. Each finger segment may be folded at a right angle relative to an adjacent finger segment. Similarly, each flap segment may be folded at a right angle relative to an adjacent flap segment. A panel may extend between retention loops to form a cable retainer. A finger and a flap segment adjacent the panel may be folded at a right angle relative to the panel.

The cable retainer formed of retention loops may include a wound cable that extends through the retention loops of the cable retainer. The loops of the wound cable may be disposed on the same plane. A removal tab may extend from the cable retainer to aid the user in removing a packaged cable from product packaging. The removal tab may be, for example, semi-circular.

The cable retainer may include a panel having at least three folds. One of the folds may not extend entirely across the panel. The fold may connect to a cut-out of the panel. A second of the folds may be formed in the cut-out and may be interrupted by a tab such that the second of the folds does not extend entirely across the cut-out. The cut-out may have a semi-circular end. A tab formed in the cut-out may have a semi-circular end and semi-circular ends of the tab and the cut-out may point in opposite directions. According to some embodiments disclosed herein, the cable retainer is formed entirely of paper, with no adhesive.

In some embodiments a cable retainer has a base panel with a tab formed from a fold in the base panel. The fold forming the tab may be located a distance from an edge of the base panel. A retention loop extends from the base panel. The retention loop is formed of retention loop panels and may have a rectangular shape. A slot is formed in one of the retention loop panels. A stepped reinforcement structure extends from the base panel. The stepped reinforcement structure has a step platform, step sidewall panels, and mating panels. The tab and the slot are configured to interlock to form a cable passage defined by the mating panel, the sidewall panel, and the retention loop panel. The interlocking structure allows the cable retainer to be formed entirely of paper and without the use of adhesives.

In some embodiments, the cable retainer may be formed of a single integrally formed piece and may be formed from a flat blank. The rectangular retention loop and stepped reinforcement structure may be formed from panels. Each panel of the retention loop and stepped reinforcement structure may be disposed at a right angle relative to each adjacent panel of the retention loop and reinforcement structure. A wound cable may be packaged using the retainer described above. The wound cable may extend through the cable passage and each loop of the wound cable may be in contact with immediately adjacent loops along a majority of each loop. In this way, each loop of the wound cable is disposed in the same plane. The wound cable may be located in the cable retainer such that a plane of the wound cable is parallel to a sidewall of the stepped reinforcement structure.

In some embodiments a cable retainer may include a base panel. The base panel includes a tab formed from a fold in the base panel. The fold forming the tab may be spaced from an edge of the base so that that tab is interior the base panel and not at an edge of the base panel. The cable retainer may also include a stepped reinforcement structure. The stepped reinforcement structure may be mated to the base. The stepped reinforcement structure may be coupled to the base panel using high frequency welding. The stepped reinforcement structure may also be used to centrally support a retained product. That is, the retained product may be supported by the reinforcement structure such that it is held above the base panel. A rectangular retention loop extends from the base panel and has a slot configured to receive the tab. When the slot and tab interlock, two cable passages are formed. In this way, the cable retainer can be formed entirely of paper and with no adhesives. Further, the tab may be removed from, and reinserted into, the slot without damaging the cable retainer.

The cable retainer may also include a product panel extending from the base panel. The product panel may reinforce the structure of the cable retainer. The product panel may also engage and retain a product retained in the cable retainer. In some uses, the product may be a charger.

In some embodiments, a cable retainer includes a product panel configured to receive a product and a pair of cable passages configured to receive a wound cable of the product located in the product receiving portion. The cable passages may be defined by a retention loop and a stepped reinforcement structure. The stepped reinforcement structure is located interior of the retention loop. The retention loop may be formed by interlocking a tab and with a slot. The tab and the slot may be formed on the retention loop. The tab and slot may be removably interlocked. Using the interlocking tab and slot allows the cable retainer to retain a cable without the use of adhesives.

In some embodiments, a cable retainer has a retention loop formed from adjacent panels. The panels may be defined by folds in the retention loop. A tab of the retention loop may be fold interior of one of the panels and spaced from a fold. In some embodiments, the retention loop is comprised of five panels.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
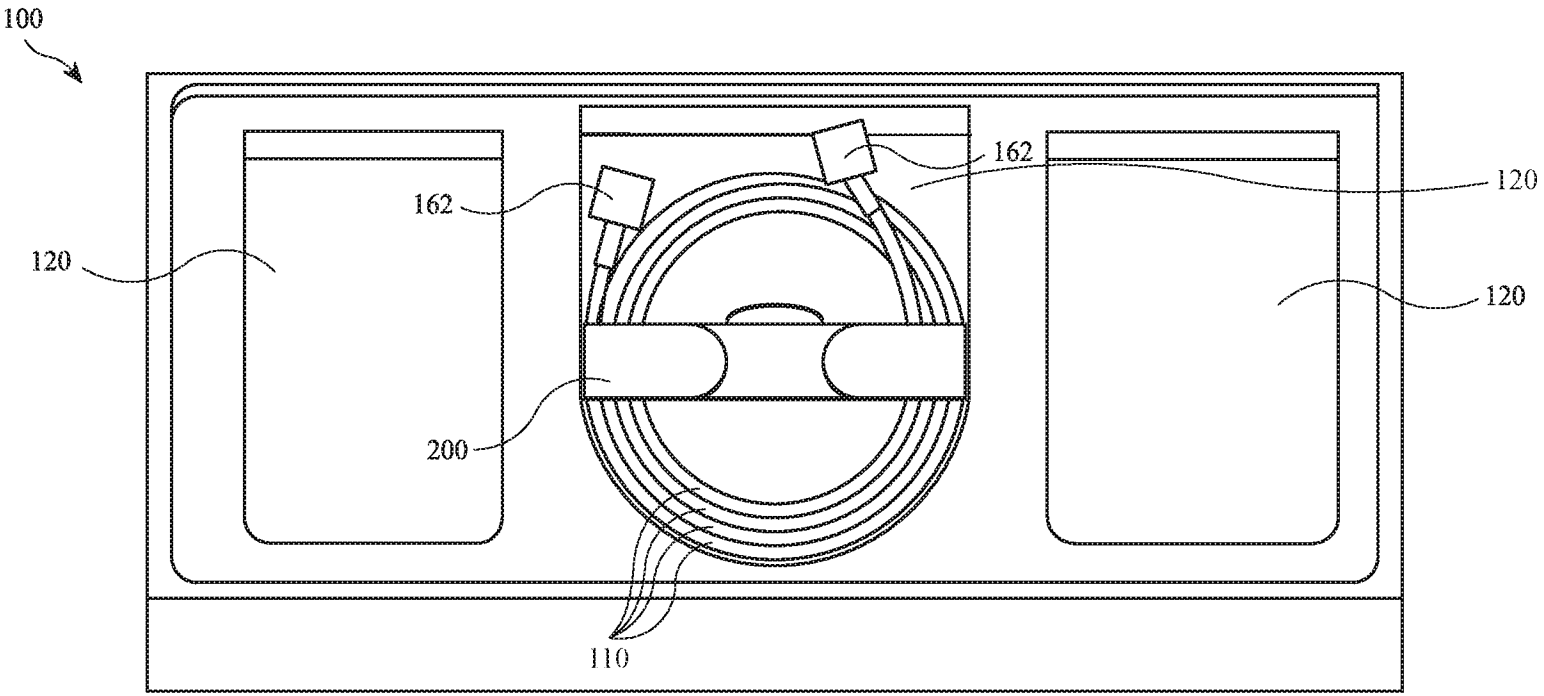
FIG. 1 shows packaging with a cable retainer.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Many products utilize cables in some form or another. For example, an electronic device may utilize one or more cables to receive or transmit power and/or data (e.g., audio or video signals). In some instances, it may be desirable to store and/or package the cable(s) (e.g., between uses, in transit, or while presented for sale).

Cable retainers protect cables and products from damage and facilitate brand recognition. Cable retainers also contribute to effective and attractive packaging and may be an important tool used to attract and retain customers. In some embodiments, cable retainers are easily undone for removal of a cable. This can reduce customer frustration.

While ease of operating cable retainers to access a retained cable may be desirable from a customer standpoint, efficiency and cost in manufacturing and constructing (assembling) cable retainers may be a consideration for manufactures and/or sellers of the packaging. For example, environmental considerations may play a role in developing cable retainers. Cable retainers made out of recyclable and/or biodegradable material can reduce environmental impact. Additionally, cable retainers that utilize minimal resources, from a material, energy, and/or labor perspective, may be desirable. For example, it may be desirable to make a cable retainer from a single raw product, such as, for example, paper. Further, cable retainers that require a relatively small number of manufacturing and/or assembly steps may reduce costs (e.g., manpower and machine costs) associated with the packaging. Maintaining desired aesthetics and function of cable retainers in view of such environmental and resource considerations can be a challenge.

The retainers discussed herein may be used to hold, display, and/or transport cables (e.g., power and/or data cables), whether separately or as connected to a product. The cable retainers discussed herein may hold and display wound cable in an aesthetically appealing and customer-friendly fashion. The cable retainers may maintain a wound cable in a compact configuration. A cable retainer may be disposed in a cavity of a packaging container, which may present a wound cable in a fashion that facilitates easy and intuitive removal of the cable retainer and/or wound cable from the packaging by a customer, such as, for example, by releasing a tab of the cable retainer from a slot of the cable retainer.

A cable retainer may be folded about the wound cable and secured to itself with the use of a tab and slot coupling. The cable retainer may present to a customer one or more free ends releasably attached to other portions of the cable retainer. Pulling the free ends may release an attachment, for example a tab from a slot, between the cable retainer and the packaging and/or between different portions of the cable retainer. Pulling on the free ends may cause the cable retainer to unfold, thereby allowing a wound cable to be removed from a packaging container and/or the cable retainer. In some embodiments, the cable retainer may be re-constructed (e.g., re-folded) by re-attaching the free ends to respective portions of the cable retainer.

Cable retainers discussed herein and features thereof may be used to package merchandise other than wound cables. In such cases, the retainer may function as a "product retainer" or "accessory retainer." For example, cable retainers discussed herein may be used to package products having a cable (or cord) physically attached to them, such as a wired headset, wired earphones, mouse, keyboard, charger, charging station, docking station, or other device. Also, packaging and cable retainers may be used to package non-wired products. For example, the cable retainers may be used to package products by being partially folded about the product. Such products/accessories may include but are not limited to, wireless headphones, wireless headsets, remote controls, or printed materials.

A cable retainer may be used to retain a cable (which may also be referred to as a cord). Typically, a cable has a length many times greater than its width. For packaging, a cable may be coiled upon itself (i.e., wound) to create a compact configuration to occupy a compact area, in order to efficiently store/package the cable. The cable may be wound any suitable number of times. Adjacent cable windings may be flush with one another. In some embodiments, the wound cable contained in the cable retainer may be described as a hanked cable. A hanked cable may have a visually appealing symmetry. In some embodiments, separate coils of the hanked cable have outer tangent lines that lie in the same plane. An exemplary, hanked cable is shown and described in U.S. Pat. No. 9,073,727, issued Jul. 7, 2015, titled "Systems and Methods for Hanking a Cable," which is incorporated herein in its entirety by reference thereto.

A cable retainer may be composed of a recyclable material (e.g., a biodegradable or compostable material). For example, the cable retainer may be composed of a paper-based product such as, for example, cardboard or paperboard (e.g., solid bleached sulfate (SBS)). The cable retainer may also be composed of a polymeric material such as, for example, polyethylene, polypropylene, polyurethane, polystyrene, polymer blends including one or more of these polymers, or co-polymers including one or more of these polymers). In some embodiments, all or some of the exterior surfaces of the cable retainer may be laminated.

Additionally, the packaging and/or cable retainers may be manufactured in a cost-effective and environmentally friendly way. For example, a cable retainer may be constructed of a single integrally formed piece of material. This piece of material may be folded into a configuration that holds and secures a wound cable, either alone or within a cavity of a packaging container. The foldable material may be a single piece of material cut by a single operation (e.g., a single die cutting operation). In some embodiments, the foldable material may be die cut from a stock material (e.g., a sheet or roll of material). Single integrally formed pieces of material cut by a single cutting operation may facilitate efficient and reproducible manufacturing of cable retainers. Moreover, such manufacturing may reduce waste material during manufacturing. Finally, mechanically interlocking portions of the packaging, for example, using a tab and slot, may reduce or completely eliminate adhesives from the cable retainer.

In some embodiments, the retainer may include a reinforcement structure. The reinforcement structure may be a separate component coupled to a portion of the retainer. The reinforcement structure may also be formed from a portion of the retainer's blank. Forming the reinforcement structure from a portion of the retainer's blank may increase the efficiency of producing the cable retainer and reduces the number of components.

The reinforcement structure may improve the structural properties of the retainer, increasing the retainer's resistance to deformation while retaining a cable. A platform of the reinforcement structure may be used to locate and support a retained product. The reinforcement structure may also define or partially define a cable passage for a retained cable. A cable retention loop may, individually or together with the reinforcement structure, define a cable passage. The cable retention loop may extend from a base portion of the retainer and around the reinforcement structure. The retention loop may restrain the retained cable and also a packaged product.

Retainers described herein and the principles that guide their operation are applicable to a wide variety of product retention and packaging applications. For example, a retainer may also retain a product. And, in some embodiments, the retainer may retain a product and a cable of the product. For example, the retainer may retain a charger for an electronic device and the charger's power cable (the power cable being a cable that transfers power from a power source to the charger).

These and other embodiments are discussed below with reference to the figures. However, those skilled in the art will readily appreciate that the detailed description given herein with respect to these figures is for explanatory purposes only and should not be construed as limiting.

In some embodiments, for example as shown in FIG. 1, a cable retainer 200 may retain a wound cable 110 in a cavity 120 of product packaging 100. Product packaging 100 may be used to package, for example, a cable alone, or a cable with other components, such as, for example, an electronic device. Product packaging 100 may include one or more additional cavities 120 for holding accessories. In some embodiments, wound cable 110 includes plugs 162. Plugs 162 may be, for example, Universal Serial Bus (USB) plugs (which may also deliver power), a High-Definition Multimedia Interface (HDMI) plug, an Ethernet plug, or a Lightning plug, manufactured by Apple Inc. of Cupertino, Calif.

Figure 2:
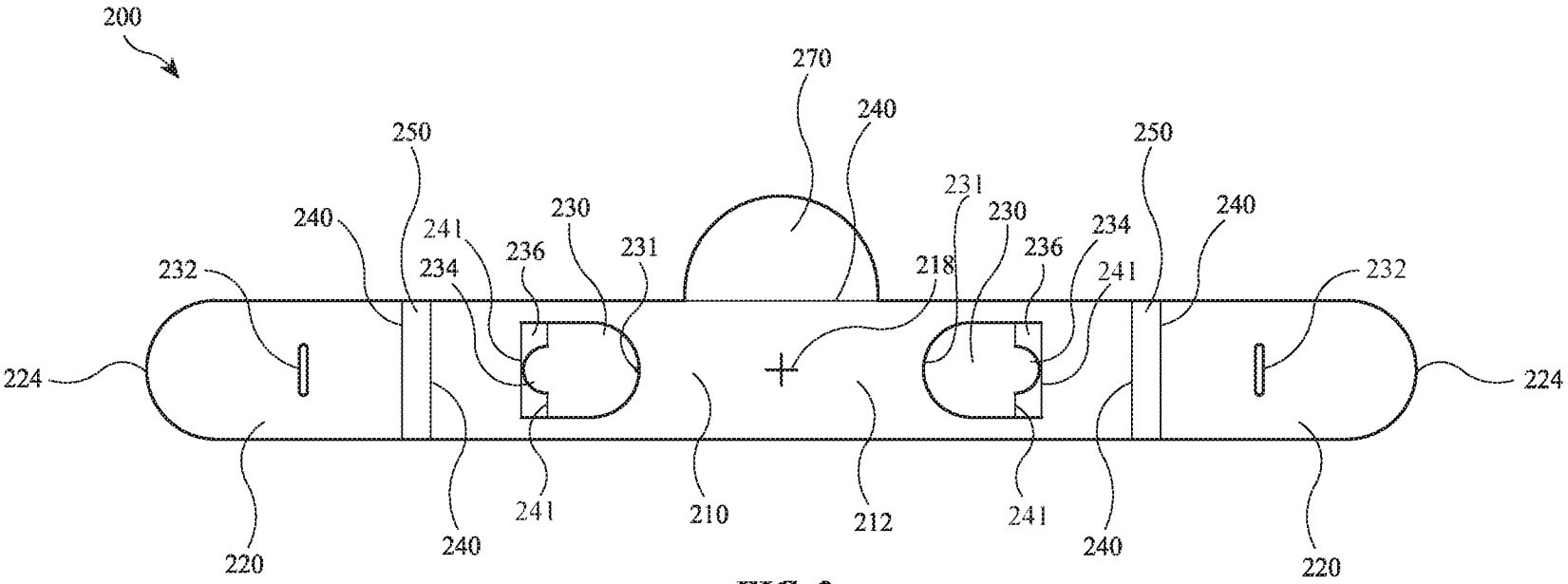
FIG. 2 shows the cable retainer in a flat configuration.
Figure 3:
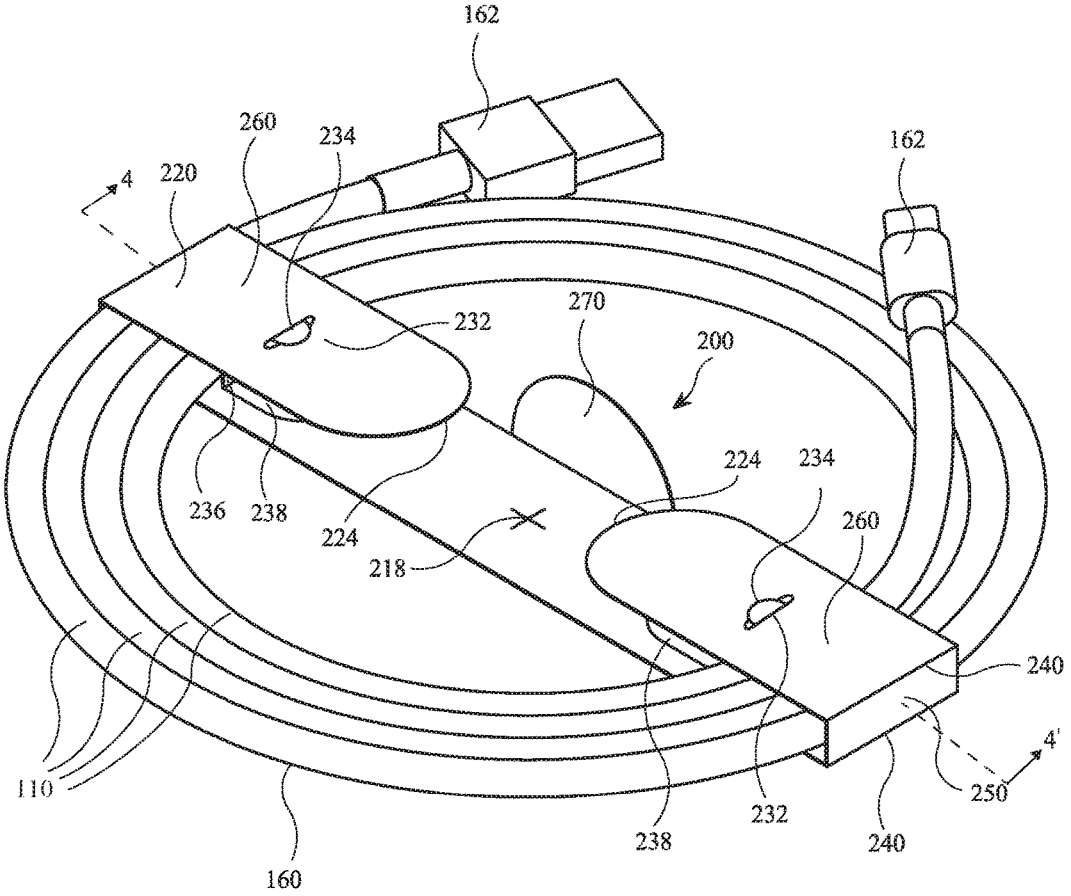
FIG. 3 shows a perspective view of the cable retainer folded about a wound cable.
Figure 4:
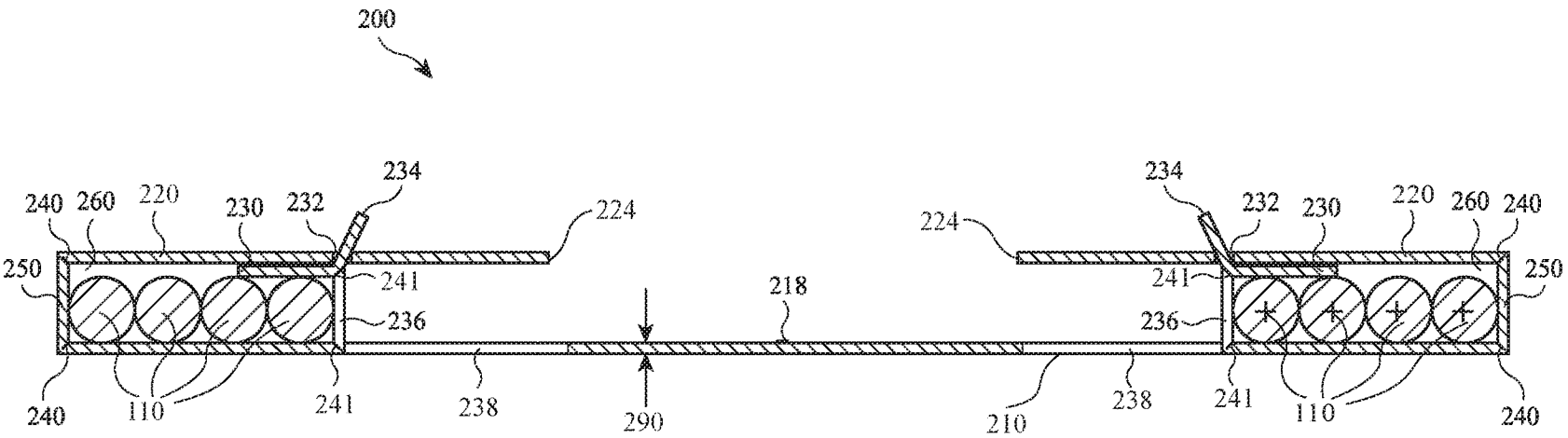
FIG. 4 shows a slice section view along the line 4-4' in FIG. 3.

As shown in FIGS. 2-4, cable retainer 200 may include a panel 210. Panel 210 may have a panel thickness 290 (see FIG. 4) of a sheet of paper or cardstock, for example, 0.1 millimeters to 1 millimeter. Panel 210 may be made entirely from paper. As used herein, paper includes paper-based materials (i.e., cellulose pulp compacted into a flat sheet and dried). Panel 210 may be made entirely from recycled paper. Additionally, the paper forming panel 210 may include a coating on its exterior surface to augment or otherwise change its visual and structural characteristics. For example, the coating may be a laminate applied to a surface of panel 210 to increase its strength or to give it a glossy appearance. A laminate may be applied to select portions of panel 210 or may be applied to the entire surface of panel 210. The coating may be tailored to the specific application of cable retainer 200. In some embodiments, the coating may be formed of a recyclable material. In this way, the coating and cable retainer 200 may be recycled without the need to separate the coating and the cable retainer and may be recycled in a single stream. The cable retainer may be formed of a single integrally formed piece. The cable retainer may also be formed of multiple pieces that mechanically lock or are otherwise coupled to one another. The integrally formed piece may be formed from a blank.

A removal tab 270 may be hingedly coupled to panel 210. Removal tab 270 may be folded up from panel 210 at fold lines 240. Removal tab 270 may aid a customer in removing cable retainer 200 with wound cable 110 from product packaging 100.

Fingers 220 are hingedly coupled to panel 210 at a fold line 240. One or more segments (e.g. a finger segment 250) may connect fingers 220 to panel 210. For example, as shown in FIG. 2, fingers 220 include finger segments 250 disposed between, and hingedly coupling, panel 210 and fingers 220. Fingers 220 include finger tips 224. Fingers 220 are formed symmetrically from panel 210 about center 218 of panel 210. Slots 232 may be cut into fingers 220. Slots 232 may be a single, narrow cut through fingers 220 or slots 232 may have a wider geometry such as an oval cut out (as shown in FIG. 2).

Fold lines 240 may be formed by, for example, structurally weakened regions of cable retainer 200 (e.g., grooves, perforated lines, and depressions formed in cable retainer 200). Such structurally weakened regions may be formed, for example, by pre-folding, compressing, or removing material from the surface of cable retainer 200. For example, grooves may be V-shaped or U-shaped and formed in a surface of cable retainer 200. The fold lines may be pre-formed into the single integrally formed cable retainer.

Cable retainer 200 may include one or more flaps 230. Flaps 230 may be formed in panel 210 and may be cut from the interior of the panel 210 such that cable retainer 200 may be formed from a single piece of paper. Flaps 230 may be coupled to panel 210 at flap fold lines 241. Flap folding members 236 may be located between, and hingedly coupled to, flaps 230 and panel 210. Flap folding members 236 may have a width approximately the same as finger segments 250. Flaps 230 may have a flap end 231 defining an extreme point of flaps 230.

Flaps 230 may include tabs 234. Tabs 234 may be formed from flaps 230 when flaps 230 are folded at a flap fold line 241. For example, tabs 234 may interrupt fold lines 241 such that fold line 241 does not extend entirely across flap 230. For example, as shown in FIG. 2, flaps 230 have tabs 234 formed opposite of flap ends 231. Tabs 234 may be formed in the same plane, and remain in the same plane, as flaps 230. Tabs 234 may be semi-circular and may face the opposite direction as a semicircular end portion of flaps 230. In some embodiments, tabs 234 may be folded from flaps 230 to lie in a different plane.

In operation, cable retainer 200 may be configured to fold from a flat configuration (see e.g., FIG. 2) to a folded configuration (see e.g., FIG. 3). In the folded configuration, fingers 220 and flaps 230 may be folded about their respective fold lines 240/241 to folded positions.

A method of constructing a cable retainer according to one embodiment will now be described in detail with reference to FIGS. 2-4. Cable retainer 200 of FIG. 2 may be used to form cable retainer 200 as shown in FIGS. 3 and 4.

Folding flaps 230 at flap fold lines 241 extends tabs 234 toward center 218 of panel 210. When flaps 230 and fingers 220 are folded, tabs 234 may pass through slots 232. Once tabs 234 pass through slots 232, fingers 220 and flaps 230 are restrained from folding back towards the flat state. In this way, cable retainer 200 may be made without the use of adhesive, using only the mechanical interlocking of tabs 234 and slots 232. Folding flaps 230 and fingers 220 creates cable passages 260. As shown in FIG. 3, cable passages 260 are rectangular, which helps securely hold cables by providing applied forces at contact points at tangents along the sides of the cable, as will be explained in more detail below with reference to FIG. 8.

Finger tips 224 may be folded toward center 218 of panel 210. Fingers 220 are folded until parallel to panel 210 and finger segments 250 are perpendicular to panel 210. Fingers 220 and finger segments 250 may be folded at finger fold lines 240. Flaps 230 may be folded at flap fold lines 241. Each fold at flap fold lines 241 of flaps 230 may be a right-angle fold such that flap ends 231 of flaps 230 moves further from center 218 of panel 210. In this way, flaps 230 are parallel to panel 210 and fingers 220 and flap folding members 236 are perpendicular to panel 210. In some embodiments, flaps 230 lie between fingers 220 and panel 210 in the folded configuration.

FIG. 3 shows a perspective view of cable retainer 200 in a folded configuration. Cable retainer 200 has wound cable 110 extending through cable passages 260. Wound cable 110 may be looped through cable passages 260 multiple times (e.g., one or more loops of wound cable 110 may extend though cable passages 260). Each loop of wound cable 110 extending through cable passages 260 is disposed on the same plane. For example, wound cable 110 may be disposed on a plane parallel to panel 210 or parallel to flap folding member 236. As seen in FIG. 3, folding flaps 230 creates voids 238 in panel. Voids 238 may be used to align cable retainer 200 in cavity 120 of product packaging 100.

A customer may remove cable retainer 200 from product packaging 100 by pulling removal tab 270. Cable retainer 200 may be sufficiently stiff such that removal tab 270 remains substantially perpendicular to panel 210 when cable retainer 200 containing wound cable 110 is held by removal tab 270 only. Removal tab 270 may take a variety of shapes, including, for example, semi-circular.

A customer may remove wound cable 110 from cable retainer 200 by pulling finger tips 224 away from center 218 of panel 210. Pulling finger tips 224 will cause tabs 234 to slide though slots 232 thereby releasing fingers 220 and tabs 234 from one another. Once fingers 220 and tabs 234 are released, wound cable 110 may be removed from cable retainer 200.

FIG. 4 shows a slice section view of cable retainer 200 and wound cable 110 taken at line 4-4' of FIG. 3. FIG. 4 shows cable retainer 200 in the folded configuration. Folded fingers 220 and folded flaps 230 form cable passages 260. Wound cable 110 lies in cable passages 260. As discussed above, cable passages 260 are formed by panel 210, finger segments 250, fingers 220, flaps 230, and flap folding members 236. Fingers 220 and flaps 230 lie parallel to one another and tabs 234 extend from the rear of flaps 230 toward center of panel 218, passing through slots 232 formed in fingers 220. Finger fold lines 240 and flap fold lines 241 are also shown for reference.

Figure 5:
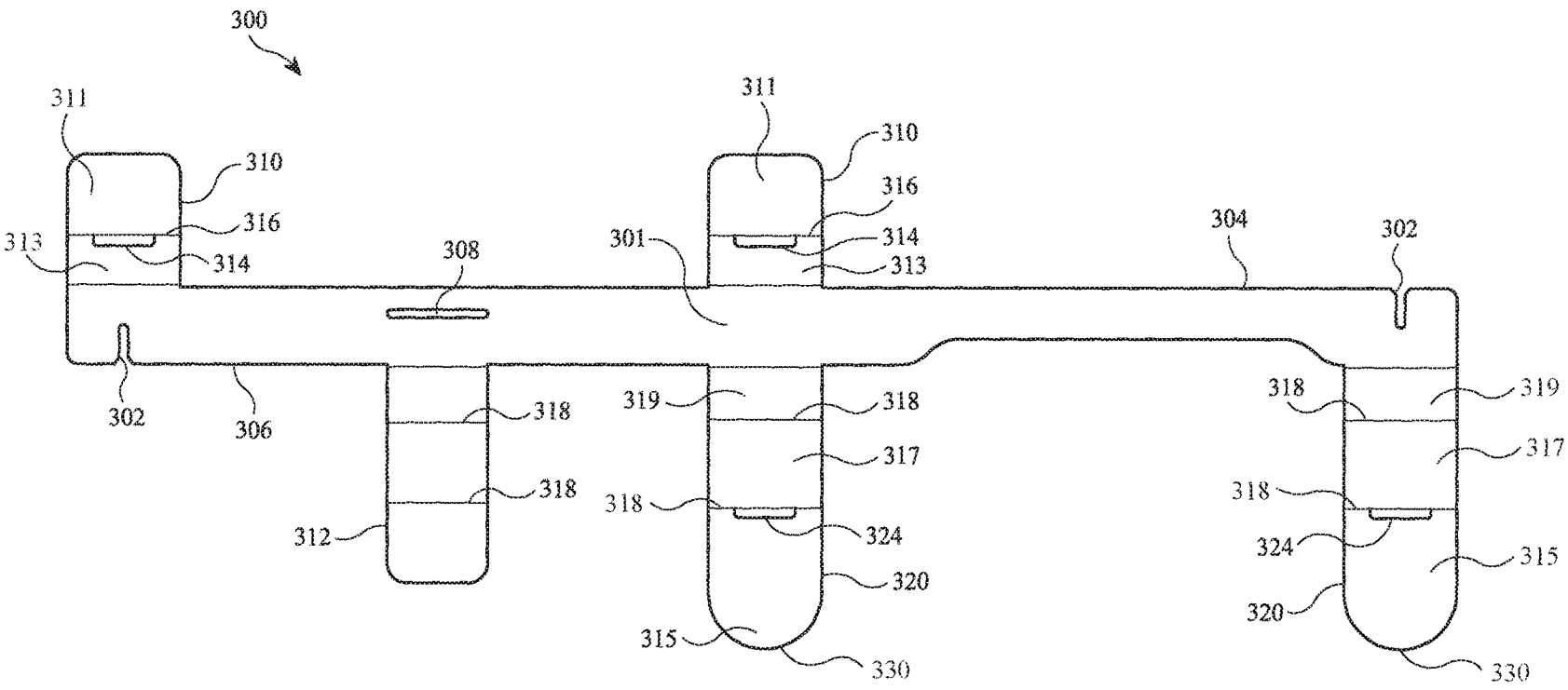
FIG. 5 shows a cable retainer in a flat configuration.

FIG. 5 shows a cable retainer 300 according to some embodiments disclosed herein. Cable retainer 300 includes panel 301. Flaps 310 extend from an upper side 304 of panel 301. In some embodiments, flaps 310 have flap fold lines 316 formed thereon. For example, fingers 320 may extend from a lower side 306 of panel 301. Flaps 310 on upper side 304 and fingers 320 on lower side 306 may be located such that when cable retainer 300 is formed into a loop, each flap 310 is opposite a finger 320. In this way, each finger 320 is paired with one flap 310. Cable retainer 300 may be formed into a loop by connecting loop locks 302.

A port securement member 312 may extend from one of the upper side 304 and lower side 306 of cable retainer 300. Port securement member 312 may have fold lines 318 formed thereon. Port securement member 312 may be folded at fold lines 318 and may be inserted into a plug 162 of a wound cable 110. Port securement member 312's natural spring between the folded portions of port securement member 312 may frictionally hold port securement member 312 inside of plugs 162. A port slit 308 may also be formed into panel 301. In some embodiments, port securement member 312 may pass through port slit 308.

A method of constructing a cable retainer according to one embodiment will now be described in detail with reference to FIGS. 5 and 6. Cable retainer 300 of FIG. 5 may be used to form cable retainer 300 as shown in FIG. 6.

Flaps 310 may be folded at a right angle at each of flap fold lines 316 such that an upper flap segment 311 of flap 310 is parallel to panel 301 and a lower flap segment 313 is perpendicular to panel 301. Once folded, tabs 314 extend in the same plane as upper flap segment 311 beyond lower flap segment 313. Fingers 320 are folded at a right angle at each of fold lines 318. Fingers 320 are composed of three segments. As shown in FIG. 5 for example, each of fingers 320 has a finger first segment 315, a finger second segment 317, and a finger third segment 319.

Figure 6:
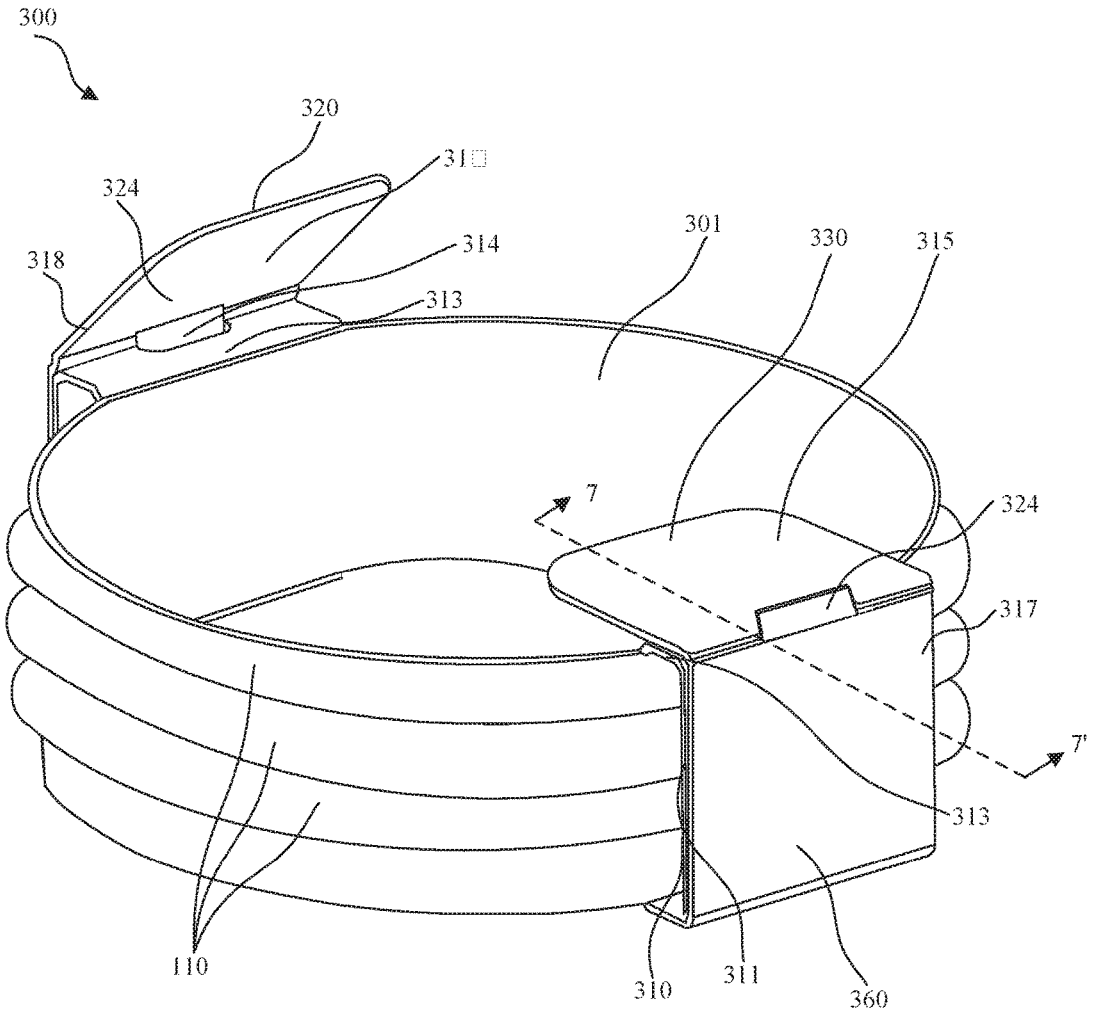
FIG. 6 shows a perspective view of the cable retainer folded about a wound cable.

FIG. 6 shows a perspective view of cable retainer 300 in a folded configuration. Cable retainer 300 has wound cable 110 extending through a cable passage 360. Wound cable 110 may be looped through cable passage 360 multiple times (e.g., one or more loops of wound cable 110 may extend though cable passage 360). Each loop of wound cable 110 that extends through cable passage 360 is disposed on the same plane. For example, wound cable 110 may be disposed on a plane parallel to panel 301.

According to some embodiments, a customer may remove wound cable 110 from cable retainer 300 by pulling finger tips 330 in the direction of tabs 324. Pulling finger tips 330 will cause tabs 314 to slide though slots 232 thereby releasing fingers 220 and tabs 314 from one another. Once fingers 320 and tabs 314 are released, wound cable 110 may be removed from cable retainer 300.

Figure 7:
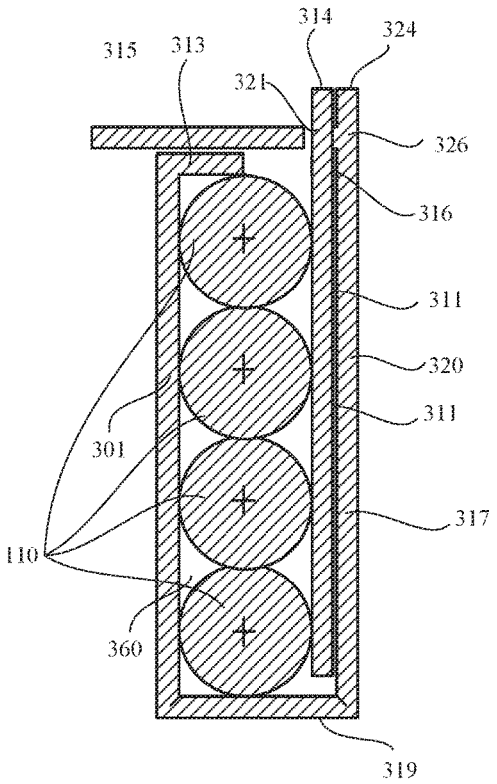
FIG. 7 shows a detail slice section view along the line 7-7' in FIG. 6.

FIG. 7 shows cable passage 360 according to some embodiments. Cable passage 360 is formed of finger first segment 315, flap segments 313, panel 301, and flaps 310. Finger first segment 315 is parallel to upper flap segment 311. Finger second segment 317 is parallel to flap 310's lower flap segment 313 and finger third segment 319 is parallel to lower flap segment 313. Tabs 314 are parallel to finger tabs 324.

As stated above, cable passage 360 is formed from panel 301, fingers 320, and flaps 310. Tabs 314 extend through slot 321 and are parallel with finger tabs 324. Finger tabs 324 are formed when fingers 320 are folded at fold line 326. The portion of finger first segment 315 that was previously adjacent finger tabs 324 becomes slot 321 through which tabs 314 may extend.

Figure 8:
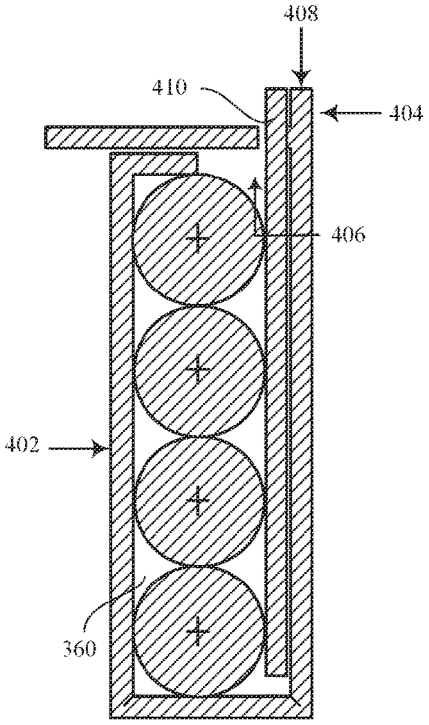
FIG. 8 shows a free body diagram of the detailed slice section view in FIG. 7.

FIG. 8 shows a free body diagram of the cable passage shown in FIG. 7. Wound cable 110 may be compressed by the walls of cable passage 360, and may act as a spring exerting forces on cable passage 360. The forces exerted by wound cable 110 contained in cable passage 360 can be resolved into horizontal force 402 and vertical force 406.

Cable passage 360 resists horizontal force 402 and vertical force 406 with tabs 314, slots 321, and finger tabs 324. With reference to FIGS. 7 and 8, horizontal force 402 is resisted by the interference of tabs 314 with the boundary of slots 321 and finger tabs 324. Vertical force 406 is resisted by the interference of tabs 314 with the boundary of slots 321. In this way, cable passage 360 is able to retain shape without the use of adhesives.

A reinforcement structure may also be formed into a cable retainer to increase the resistance to deformation of the cable retainer when the cable retainer holds a wound cable. FIGS. 9-12 show a cable retainer with a reinforcement structure in various states of assembly and use according to some embodiments. The reinforcement structure, together with other portions of the cable retainer, may define cable passages for the wound cable. The retainer shown in FIGS. 9-12 may also retain a product together with its cable.

Figure 9:
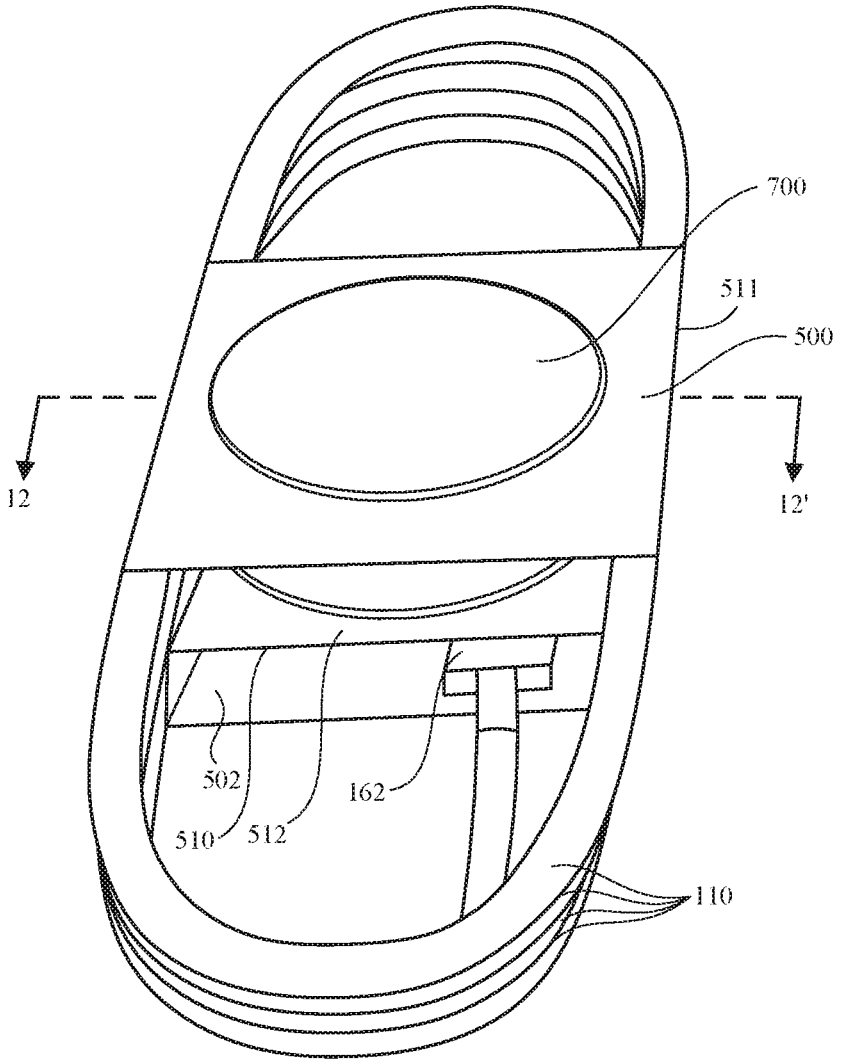
FIG. 9 shows a perspective view of a cable retainer folded about a wound cable and product.

FIG. 9 shows an embodiment of cable retainer 500 in the assembled configuration. Cable retainer 500 retains product 700 and retained wound cable 110. Cable retainer 500 may package product 700 and wound cable 110 without the use of adhesives and only with mechanical interlocking structures. In some embodiments, cable retainer 500 may be formed by folding panels of cable retainer 500 around product 700 and wound cable 110. A panel of cable retainer 500 may engage a tab formed in another panel of cable retainer 500 to complete the assembly and to provide an easy way for a user to open cable retainer 500 and release product 700 and wound cable 110. According to these and other embodiments, cable retainer 500 may be formed as an integrally formed piece (e.g., of sheet material, such as paper) that includes a series of panels.

In some embodiments, for example, as shown in FIG. 9, cable retainer 500 uses a reinforcement structure 510 to form cable passages. Reinforcement structure 510 also maintains the structure of cable retainer 500. Cable retainer 500 serves to package retained product 700 and product 700's wound cable 110. Plug 162 is coupled to the opposite end of wound cable 110 from product 700. FIG. 9 shows plug 162 disposed between a base panel 502 and a reinforcement platform 512 of cable retainer 500.

Figure 10:
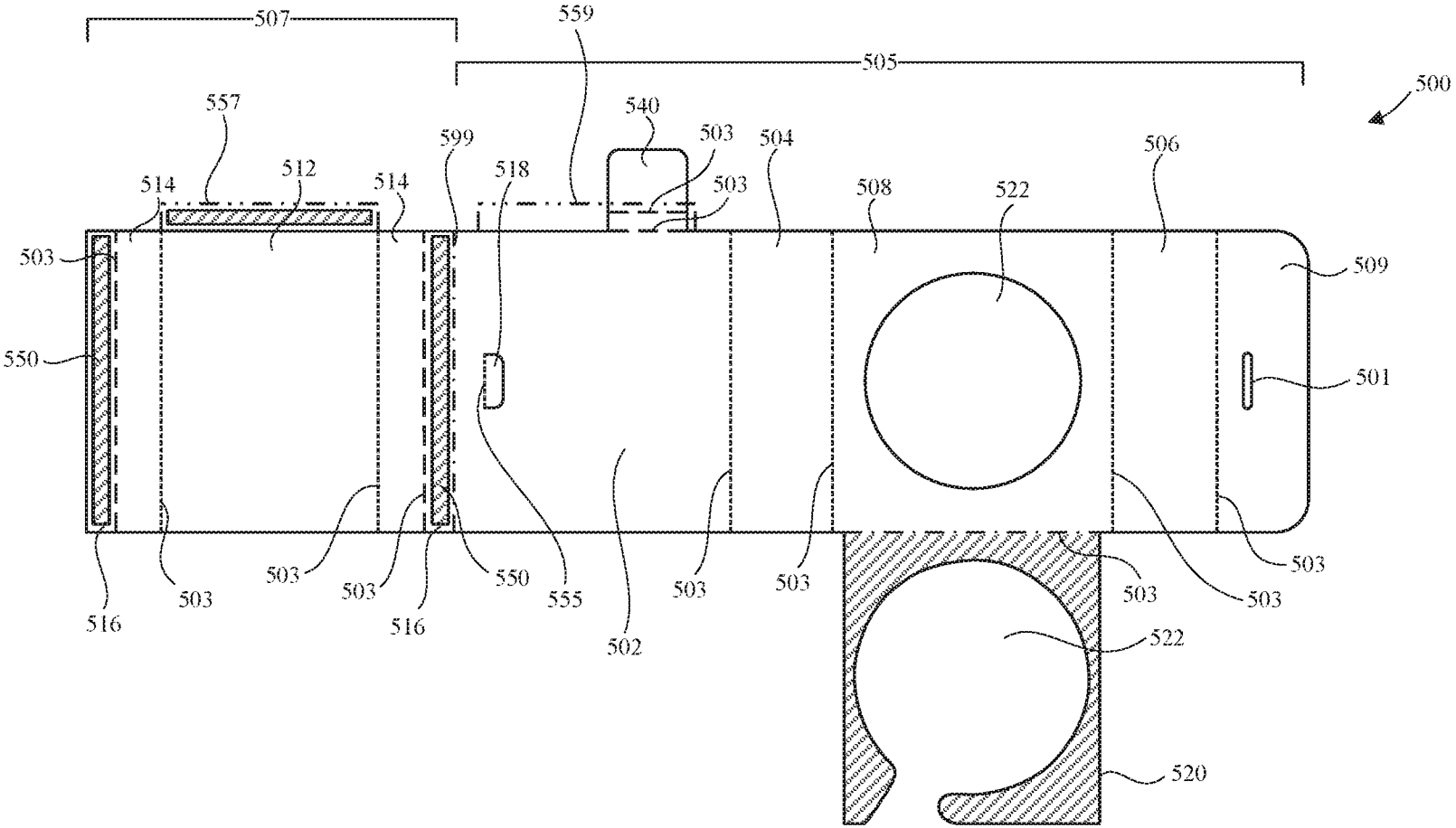
FIG. 10 shows the cable retainer blank used form the cable retainer of FIG. 9 in a flat configuration.

Cable retainer 500 may be formed in whole or in part from a flat blank. For example, FIG. 10 shows cable retainer 500 from FIG. 9 as a blank in a flat configuration. Cable retainer 500 includes several panels (including, for example, 516, 514, 512, 502, 504, 540, 508, 506, 509, 520). Cable retainer 500 may be formed of paper in a similar manner as cable retainer 200 discussed above. Cable retainer 500's panels are separated by fold lines 503 and 599. As disclosed above, fold lines 503 and 599 may be formed by, for example, structurally weakened regions of cable retainer 500 (e.g., grooves, perforated lines, and depressions formed in cable retainer 500). Such structurally weakened regions may be formed, for example, by pre-folding, compressing, or removing material from the surface of cable retainer 500. For example, grooves may be V-shaped or U-shaped and formed in a surface of cable retainer 500. The fold lines may be preformed into the single-integrally formed cable retainer 500.

Cable retainer 500 may include groups of panels configured to form different structures of cable retainer 500. In some embodiments, cable retainer 500 may include panels to form a cable retention loop and panels to form reinforcement structure 510 of the cable retainer. For example, cable retainer 500 shown in FIG. 10 includes two groups of panels: retention loop panels 505 and reinforcement structure panels 507. Retention loop panels 505 form a retention loop 511 in the finished cable retainer 500. Reinforcement structure panels 507 form reinforcement structure 510 in the finished cable retainer. As shown in FIG. 10, the two groups of panels are separated by fold line 599.

As shown in FIG. 10, retention loop panels 505 include a base panel 502, side wall panels 504, 506, a product display panel 508, and a release panel 509. Side wall panel 504 is disposed between base panel 502 and product display panel 508. Side wall panel 506 is disposed between product display panel 508 and release panel 509.

Reinforcement structure panels 507 extend from base panel 502 of retention loop panels 505. Reinforcement structure panels 507 include mating panels 516, a reinforcement platform 512, and reinforcement structure side walls 514. Mating panels 516 are located at opposite ends of reinforcement structure panels 507, with one of mating panels 516 extending from base panel 502. Reinforcement structure side walls 514 are disposed between reinforcement platform 512 and mating panels 516. Reinforcement structure 510 may be said to be a stepped structure because of the paneled design of reinforcement structure 510. That is, reinforcement structure side walls 514 may be a step of reinforcement platform 512.

Figure 11:
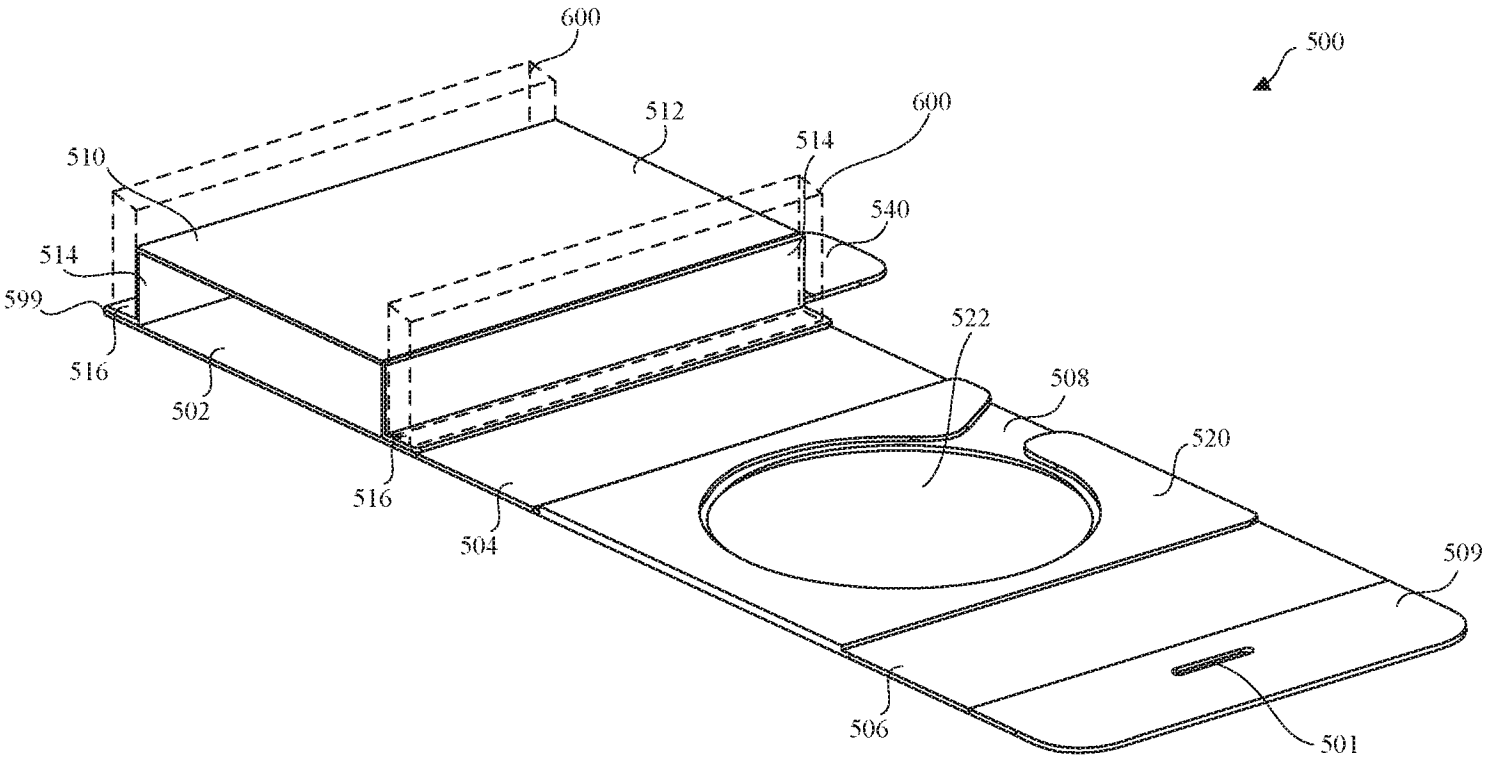
FIG. 11 shows a perspective view of a cable retainer formed from the blank of FIG. 10 in an open configuration.

Reinforcement structure panels 507 may be secured to retention loop panels 505 to form reinforcement structure 510. FIGS. 10 and 11 show reinforcement structure 510's mating panels 516. Mating panels 516 may be coupled to retention loop panels 505 with or without the use of adhesives. For example, as shown in FIG. 11, mating panels 516 may be coupled to base panel 502 using high frequency welding to couple mating zones 550 of mating panels 516 to base panel 502 without using adhesives. In some embodiments, rear reinforcement structure panels 557 and 559 may extend from reinforcement platform 512 and base panel 502, respectively instead of a port securement member 540. Rear reinforcement structure panels 557 and 559 may be mated when cable retainer 500 is in the folded or partial folded configuration. Rear reinforcement structure panels 557 and 559 may be high frequency welded together and may partly close one end of reinforcement structure 510.

FIG. 10 shows product panel 520. Product panel 520 extends from product display panel 508. Product panel 520 and product display panel 508 include voids 522. Voids 522 may permit a customer to view a retained product upon opening product packaging 100, thereby promoting immediate identification of product 700 and intuitive unpacking by the user. Voids 522 may be any number of shapes and may correspond to a shape of a retained product or a portion thereof. Further, product panel 520's void may mirror or partially mirror the shape of void 522. In some embodiments, such as cable retainer 500 shown in FIG. 10, product panel 520 is folded on to product display panel 508. Product panel 520 may be secured to product display panel 508 with or without the use of adhesives. For example, product panel 520 may be secured to product display panel 508 using high-frequency welding.

Cable retainer 500 may be formed by folding the flat, integrated panel shown in FIG. 10 at the identified fold lines. FIG. 10 shows fold lines 503 in thin dotted lines, thick dotted lines, or dot-dash lines. According to some methods of forming cable retainer 500, the embodiment shown in FIG. 10 may be folded with each thin dotted line representing an upward 90 degree fold, each thick dotted line representing a downward 90 degree fold, and each dot-dash line representing a 180 degree fold. Fold line 599, which separates the retention loop panels 505 and reinforcement structure panels 507 may be folded 180 degrees out of the page such that mating panel 516 is parallel to base panel 502.

FIG. 11 shows cable retainer 500 of FIG. 10 in a partially assembled configuration. In this configuration, FIG. 11 is configured to receive a product, such as, for example, a wound cable, which may be placed over reinforcement structure 510. Reinforcement structure 510 is formed on base panel 502. Reinforcement structure 510 prevents deformation of base panel 502 and reinforces the structure of cable retainer 500. Reinforcement structure 510 is formed by folding reinforcement structure panels 507 as described, and securing mating zones 550 to base panel 502. Reinforcement structure side walls 514 extend perpendicular to mating panels 516. Reinforcement platform 512 extends between reinforcement structure side walls 514. Products, product accessories, or cable components may be located in the space between reinforcement platform 512 and base panel 502. For example, plug 162 of a wound cable retained in cable retainer 500 may be placed in this space, as shown in FIG. 9. Plug 162 may engage a port securement member 540 of cable retainer 500. Port securement member 530 may be folded and inserted into plug 162 to hold plug 162 in place.

Figure 12:
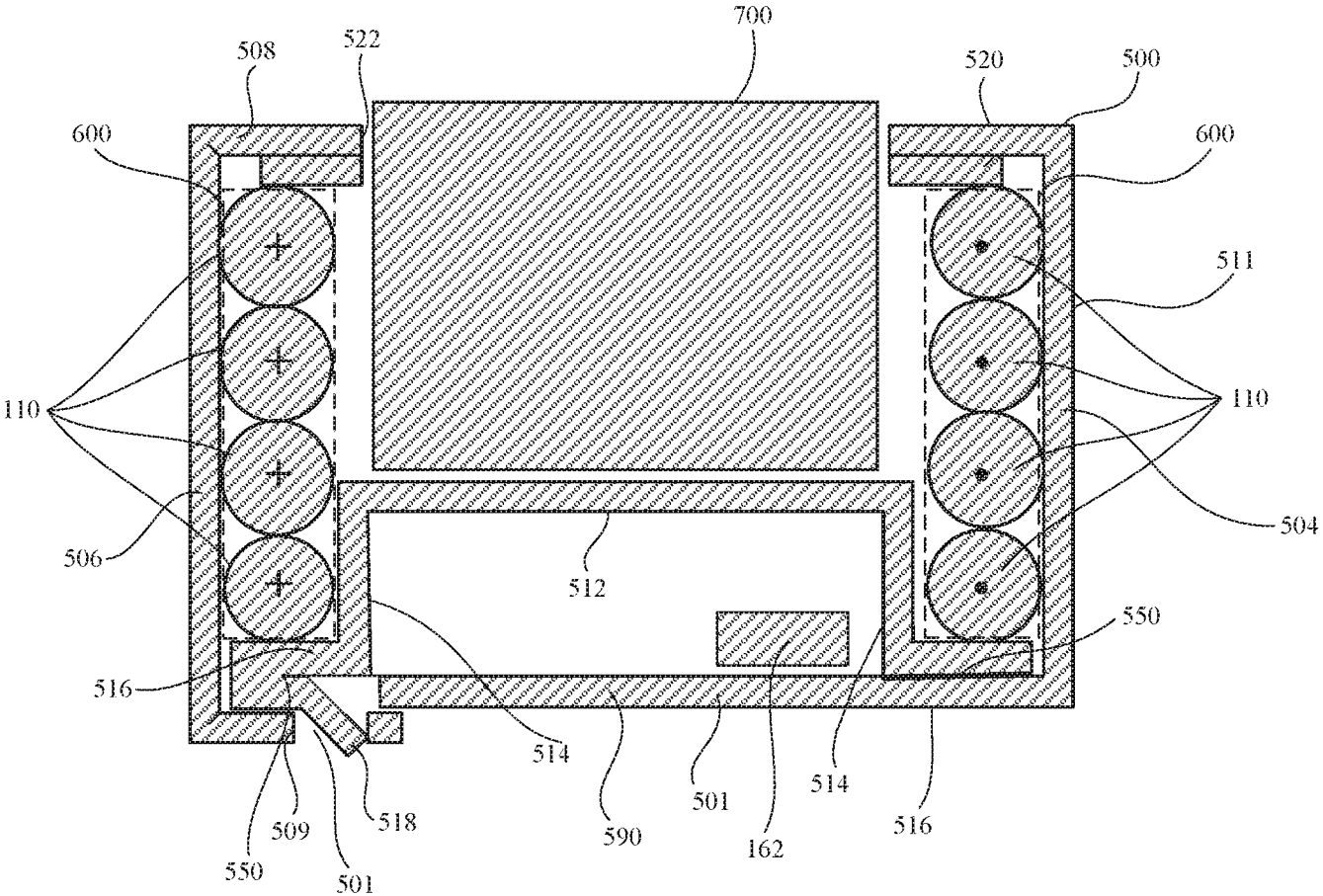
FIG. 12 shows a detail slice section view along the line 12-12' in FIG. 9.

FIG. 11 also shows slot 501 on release panel 509. Slot 501 is engaged by tab 518 formed in base panel 502 when cable retainer 500 is closed. Retention loop 511 may be secured to itself by interlocking tab 518 and slot 501. Tab 518 is formed by raising tab 518 out of base panel 502 for insertion into slot 501. Unlike tabs 234 in cable retainer 200 above, tab 518 is not formed on a fold line, but is formed between fold lines of a panel, thus making it positionable along a face of cable retainer 500, not necessarily at a corner thereof. Tab 518 is spaced apart the edge of base panel 502 and is interior to base panel 502. Tab 518 may be connected to base panel 502 at tab fold line 555. FIG. 12 shows a slice section view of tab 518 engaged with slot 501.

FIG. 11 also shows a plug securement member 540 extending from base panel 502. As discussed above, plug securement member 540 is configured to engage plug 162 of retained wound cable 110. Plug securement member 540 secures plug 162 to cable retainer 500 to prevent plug 162 from moving. Plug securement member 540 also locates plug 162 during the packaging process to aid in efficient packaging that present a visually appealing packaged product.

According to some embodiments, portions of cable retainer 500 define cable passages 600. For example, reinforcement structure side walls 514, mating panels 516, side wall panels 504, 506, and product display panel 508, when folded, define cable passages 600. FIG. 11 shows cable passages 600 before closed off by side wall panels 504, 506, and product display panel 508. Cable passages 600 are configured to receive wound cable 110. Wound cable 110, as described above, may be wound such that each loop of the wound cable 110 is immediately adjacent to another loop of wound cable 110. The immediately-adjacent loops of wound cable 110 may be placed in cable passages 600 and retainer loop panels 505 may be folded about retained wound cable 110. According to some embodiments, reinforcement structure 510 is assembled and a product 700 is placed on reinforcement platform 512. Wound cable 110, coupled to product 700, is placed such that a side wall formed by wound cable 110 is parallel to reinforcement structure side wall 514. Once in place, retainer loop panels 505 may be folded around product 700 at fold lines 503.

FIG. 11 also shows product panel 520 secured to product display panel 508. Product panel 520 may be secured to product display panel 508 using high frequency welding. Product panel 520 and product display panel 508 have concentrically aligned voids 522 that allow a portion of a retained product to be visible to a customer interacting with a product retained in cable retainer 500.

Product panel 520 serves at least two functions. First, product panel 520 increases the rigidity of product display panel 508. This helps restrain a retained product. Second, product panel 520 increases the thickness of product display panel 508 thereby increasing product display panel 508's resistance to tearing or deflecting.

FIG. 12 shows a slice section view of cable retainer 500 taken at the line 12-12' in FIG. 9. FIG. 12 shows cable retainer 500 in the folded configuration. Cable passages 600 are formed from reinforcement structure 510 and retention loop 511. Reinforcement structure 510 has a generally rectangular cross section and is formed by coupling mating panels 516 to base panel 502 at mating zones 550. Reinforcement structure side walls 514, mating panels 516, product display panel 508, and side wall panels 504, 506 form the generally rectangular structure of cable passages 600 as shown. Tab 518 passes through slot 501 in release panel 509 to secure release panel 509 to base panel 502 to form retention loop 511. FIG. 12 shows panels of cable retainer 500 having a panel thickness 590.

Wound cable 110 may be compressed by retention loop 511. Wound cable 110 may also act as a spring and exert force parallel to base panel 502. The force exerted by wound cable 110 is countered by tab 518 and slot 501's interlocked coupling. The interlocked coupling of tab 518 and slot 501 allows cable retainer 500 to be assembled without the use of an adhesive.

A customer wishing to access product 700 in cable retainer 500 can pull release panel 509 away from base panel 502. This will remove tab 518 from slot 501. Once tab 518 is removed from slot 501, the customer may "unwrap" product 700 from cable retainer. Product display panel 508, which includes void 522, will slip off of retained product as product display panel 508 is lifted away from product 700. Once product display panel 508 is lifted away, a customer will be able to access product 700 and wound cable 110 in cable retainer 500. The use of interlocking tab 518 and slot 501 also reduces customer frustration because cable retainer 500 remains a unitary piece after product 700 and wound cable 110 are removed. This reduces the number of pieces of waste the customer will need to dispose of or recycle.

Retainers using mechanical interlocks such as those described herein may be used to retain material or products for storage, shipping, packaging, or displaying. For example, a retainer using a mechanical interlock may be used to bundle pencils together. Further, retainers may be used to bundle related customer products such as, for example, a printer cord and printer ink, into a single integrated packaging unit. The retainer may also retain a cable and a portion of a retained product, such as, for example, a charger and charging cable or headphone cables and headphones.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention(s) should not be limited by any of the above-described exemplary embodiments, but should be defined only in accordance with the claims and their equivalents.

What is claimed is:

1. A cable retainer comprising:
a base panel having a tab formed in an interior of the base panel and spaced from an edge of the base panel;
a rectangular retention loop extending from the base panel and formed of retention loop panels folded at right angles relative to each other;
a slot formed in the retention loop;
a stepped reinforcement structure extending from the base panel, the stepped reinforcement structure comprising:
a step platform;
step sidewall panels; and
mating panels,
wherein the tab and slot interlock to form a cable passage defined by one of the mating panels, one of the step sidewall panels, and one of the retention loop panels; and
wherein the retainer is formed entirely of paper, with no adhesive.

2. The cable retainer of claim 1, wherein the cable retainer is a single integrally formed piece.

3. The cable retainer of claim 2, wherein the single integrally formed piece is formed from a flat blank.

4. The cable retainer of claim 3, wherein the stepped reinforcement structure is formed of panels folded at right angles relative to each other.

5. A packaged cable comprising:
the cable retainer of claim 1;
a wound cable extending through the cable passages.

6. The packaged cable of claim 5, wherein the cable is wound such that each loop of the cable is in contact with immediately adjacent loops along a majority of each loop.

7. A cable retainer comprising:
a base panel having a tab formed in an interior of the base panel and spaced from an edge of the base panel;
a stepped reinforcement structure having mating panels mated to the base panel;
a rectangular retention loop extending from the base panel and formed of retention loop panels folded at right angles relative to each other; and
a slot formed in the retention loop,
wherein the tab and the slot interlock to form two cable passages, and
wherein the retainer is formed entirely of paper, with no adhesive.

8. The cable retainer of claim 7, wherein the mating panels are high-frequency welded to the base panel.

9. The cable retainer of claim 7, wherein the tab and slot are removably interlocked.

10. A packaged product comprising:
the cable retainer of claim 7;
a wound cable extending through the cable passages; and
a product retained by a product panel.

11. A cable retainer comprising:
a retention loop having an interlocking tab and slot;
a stepped reinforcement structure interior of the retention loop; and
a product display panel configured to receive and display a product disposed on the product display panel,
wherein the stepped reinforcement structure and the retention loop define cable passages, and
wherein the retainer is formed entirely of paper, with no adhesive.

12. The cable retainer of claim 11, further comprising:
a foldable port securement member;
wherein the port securement member is configured to mate with a port of a retained cable.

13. A packaged product comprising:
the cable retainer of claim 11;
a wound cable extending through the cable passages; and
a product located in the product display panel,
wherein the product is a charger.

14. The packaged product of claim 13, wherein the stepped reinforcement structure centrally supports the product within the cable retainer.

15. The cable retainer of claim 11, wherein the retention loop is comprised of retention loop panels defined by folds.

16. The cable retainer of claim 15, wherein the tab is formed in the interior of a retention loop panel and spaced from any fold between panels of the retention loop.

17. The cable retainer of claim 15, wherein the retention loop is comprised of five retention loop panels.

18. The cable retainer of claim 11, further comprising a product panel extending from the product display panel.

19. The cable retainer of claim 18, wherein the product panel is high-frequency welded to the product display panel.

20. The cable retainer of claim 11, wherein the stepped reinforcement structure is comprised of three stepped reinforcement panels.

* * * * *